United States Patent [19]

Death

[11] 4,208,206

[45] Jun. 17, 1980

[54] METHOD FOR PRODUCING IMPROVED METAL CASTINGS BY PNEUMATICALLY REFINING THE MELT

[75] Inventor: Frank S. Death, Carmel, N.Y.

[73] Assignee: Union Carbide Corporation, New York, N.Y.

[21] Appl. No.: 931,625

[22] Filed: Aug. 7, 1978

Related U.S. Application Data

[63] Continuation of Ser. No. 783,431, Mar. 31, 1977, abandoned.

[51] Int. Cl.[2] ..... G21C 5/34

[52] U.S. Cl. ..... 75/60; 75/59

[58] Field of Search ..... 75/59, 60

[56] References Cited

U.S. PATENT DOCUMENTS

| | | | |
|---|---|---|---|
| 3,169,058 | 2/1975 | Nelson | 75/59 |
| 3,706,549 | 12/1972 | Knuppel | 75/60 |

*Primary Examiner*—P. D. Rosenberg

*Attorney, Agent, or Firm*—Lawrence G. Kastriner

[57] ABSTRACT

Castings of superior surface quality and internal quality can be produced by:

(1) transferring the melt from the furnace into a separate refining vessel provided with submerged tuyeres, and (2) refining the melt by (a) injecting into the melt through the tuyeres an oxygen-containing gas which may contain up to 90% of a dilution gas, and (b) thereafter injecting a sparging gas into the melt through the tuyeres.

Preferably, the oxygen-containing gas is surrounded by an annular stream of a protective fluid. Argon is preferred for dilution, protection as well as sparging.

11 Claims, 1 Drawing Figure

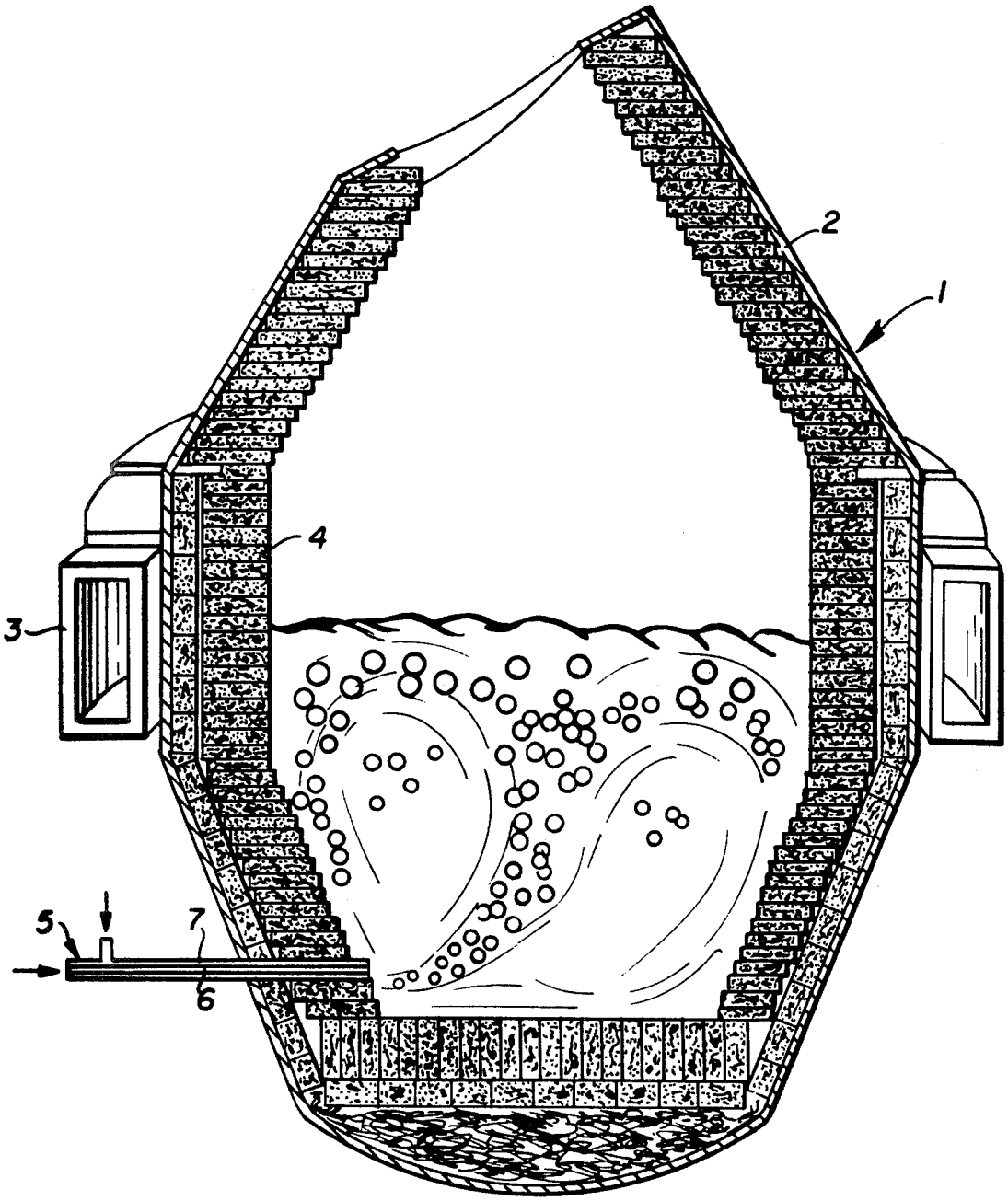
1
2
3
4
5
6
7

METHOD FOR PRODUCING IMPROVED METAL CASTINGS BY PNEUMATICALLY REFINING THE MELT

BACKGROUND

This application is a continuation of application Ser. No. 783,431 filed Mar. 31, 1977, now abandoned.

This application relates in general to the manufacture of metal castings, and more particularly to a method for improving the quality of castings by pneumatically refining the melt prior to casting.

Metal articles are generally divided into two product classifications depending on their method of manufacture, wrought products and cast products. Wrought products are made by first teeming molten metal into a mold, and then mechanically working or deforming the intermediate product by rolling, drawing, extruding or forging. In contrast, cast products are made without the second step. i.e., without the mechanical deformation of the solidified product. While cast products are generally heat treated, and may also be mechanically cleaned, machined or repaired subsequent to casting, they are not subject to plastic deformation.

This difference between a wrought and a cast product, i.e., the presence of absence of mechanical deformation, is extremely important because it offers the manufacturer of wrought products opportunities to correct or eliminate various defects which may have occurred during solidification. For example, it is well known that while solidified ingots of rimmed steel have very good surface characteristics, they contain many small blow holes beneath the surface. Similarly, in most continously cast steel shapes, there is a center region containing shrinkage porosity. Nonetheless, these blow holes and regions of porosity are almost entirely eliminated during subsequent rolling, and the final wrought product contains virtually no evidence of the original porosity.

Similarly, surface defects in ingots, slabs and billets are not a problem to the producer of wrought products, because these are intermediate products which undergo considerable mechanical reworking and plastic deformation prior to shipment. Furthermore, when surface defects occur, they can readily be removed by grinding or scarfing before further mechanical processing. In contrast, the surface quality of castings is very important because castings are a final product and any defect must be removed by costly and time consuming manual grinding, gauging or chipping. Then the cavity so caused must be rebuilt by welding or overlaying of metal. In addition, surface repair may diminish the dimensional accuracy and mechanical properties of the casting.

It is evident, therefore, that since ingots, slabs and billets are intermediate products, certain surface and internal defects can be tolerated in them, while in castings such defects cannot, because castings are poured directly into their final shape.

The metal founding industry has long been plagued with a number of difficult problems caused by unsatisfactory castings. These problems are due both to surface defects and to internal defects. While many surface defects can be remedied by the costly finishing operations mentioned above, internally defective castings frequently have to be scrapped, remelted and cast over. Some of the common surface flaws in casting include: hot tears, surface cracks, rough surface, and holes ranging in size from pinholes to gross blow holes. In general, the ultimate causes of these defects are not well understood. Consequently, melting and casting practices to produce satisfactory castings require a large amount of experience and empirical evaluation. Internal defects are due mainly to porosity and inclusions which adversely effect the mechanical properties of castings, i.e., its strength, ductility, toughness and impact resistance. The above-mentioned defects, as well as others such as embrittlement, age-hardening and the presence of fish-eyes or white spots, are believed to be related to the presence of uncontrolled amounts of oxygen, nitrogen, hydrogen, phosphorous and sulfur in the melt. Consequently, it has long been an objective of the foundry industry to produce sound castings with low or controlled levels of these five elements. In the production of stainless castings, where corrosion resistance is of paramount importance, it is often an additional objective to produce sound castings with low carbon levels.

Casting defects are conventionally remedied during the so-called finishing operations. Most of these operations are highly labor intensive and consequently very costly. In addition, much of the finishing consists of grinding which causes dust that can be harmful to health. Some castings, however, cannot be repaired because the critical application for the part does not allow it. In such case, the defective casting must be scrapped. Consequently, the foundry art has long sought a method which would improve castings both in terms of their surface quality and physical properties.

Various techniques have been used in the foundry art to refine melts prior to casting in order to improve the quality of the resultant castings. The final stage of melting often includes some form of purification or refining treatment intended to influence the microstructure and cleanliness of the casting. Such treatments usually involve the blowing of gases or the addition of certain reagents to the furnace or transfer ladle. These treatments may include decarburization, dephosphorization, deoxidation, desulfurization and degassing.

Prior to the present invention, decarburization of molten steel for castings, was generally accomplished by blowing oxygen into the melt through a consumable lance inserted through an opening in the furnace. This technique of decarburization is, in the first place, dangerous to the operator because it exposes him to hot metal and sparks, and because the operator usually holds the lance manually, which is in itself hazardous. Secondly, this technique of decarburization is frequently inaccurate because all the oxygen does not always react with the bath. Hence, it is often necessary to reblow the molten steel because insufficient carbon was removed initially. Lastly, such prior art methods of decarburization tend to generate a great deal of fume and smoke which is hazardous to health and damaging to the environment.

Because of the presence of oxygen is known to be detrimental to the properties of the castings, foundries generally deoxidize the molten metal prior to pouring. In addition, deoxidation is generally required to prevent the formation of blow holes during solidification. This is normally accomplished by the addition of well-known deoxidants such as silicon or aluminum, and also by the addition of special deoxidants, such as "Calcibar" and "Hypercal." The attainment of a well deoxidized melt prior to casting is essential for the production of sound, tough castings.

Desulfurization of molten steel for castings, prior to this invention, has generally been accomplished by the formation of basic slags in the furnace, i.e., slags containing a high ratio of lime to silica or lime to alumina, and by subsequently mixing the slags with well deoxidized metal. Equilibrium between the slag and the metal causes the sulfur to be transferred from the metal to the slag. This process is very slow, often requiring several hours, particularly when very low (i.e., under 0.005%) sulfur is desired. Indeed, it is often necessary to remove the slag and to produce a new one. Sometimes this step has to be repeated several times in order to reach the desired low level of sulfur. This process is very laborious and time consuming, and unnecessarily exposes the furnace operators to molten metal and to unhealthy fumes. An alternative, and much more costly desulfurization technique is to add expensive sulfur scavenging elements, such as calcium, magnesium or the rare earth elements, to the furnace immediately prior to tapping or to the transfer ladle. The expense of this technique, as well as its non-reproducibility, militates against its general use.

Known degassing treatments include vacuum melting, vacuum degassing, as well as degassing by bubbling scavenging gases, such as argon, through the melt. While argon degassing in the ladle, prior to casting, can improve the quality of castings by lowering the hydrogen and oxygen content of the melt, it does not remove all impurities or achieve low hydrogen levels in the limited time available. Because the time available for degassing is strictly limited by heat loss from the degassing vessel, it has been found that it is not possible to lower the dissolved gas content sufficiently for many applications. Furthermore, degassing by itself does not remove sulfur and may necessitate reheating the melt in order to obtain sufficient fluidity for casting.

Prior to the present invention, therefore, the foundry art utilized the above-described techniques in an effort to produce defect-free castings. However, these prior art techniques are expensive, often inaccurate or non-reproducible, time-consuming, generally hazardous to the health of the operators, and by-and-large inadequate to the needs of the industry. Consequently, extensive post-solidification repair of castings is usually still required. In fact, in castings, for example, destined for nuclear applications, the cost of inspection and repair often exceeds the material value of the castings themselves.

During the past twenty-five years, the manufacturers of wrought steel products have made large gains in upgrading their molten metal processing techniques through the adoption of one of several now well known refining processes such as the BOF, AOD, OBM or Q-BOP and LWS processes. U.S. Pat. Nos. illustrative of these processes, respectively, are: 2,800,631; 3,252,790; 3,706,549; 3,930,843 and 3,844,768. The production of wrought steels containing controlled levels of carbon, phosphorous, sulfur, oxygen, nitrogen and hydrogen is now readily and economically achievable through judicious selection of one, or a combination of more than one, of the above processes. In the foundry or cast metal industry, however, comparable advances have been absent. While the industry has, at various times, produced products with low or controlled levels of one or perhaps two of the above six elements, the manufacture of castings with low or controlled levels of all six elements has hitherto not been possible, and consequently, the value or advantages of being able to control all six elements have hitherto not been known.

The pneumatic treatment of molten stainless steel for the production of wrought steel by the simultaneous injection of argon and oxygen into the melt, commonly referred to as the AOD process, has achieved wide commercial acceptance in stainless steel mills for the manufacture of wrought products. The basic AOD refining process is disclosed by Krivsky in U.S. Pat. No. 3,752,790. An improvement on Krivsky relating to the programmed blowing of the gases is disclosed in Nelson et al, U.S. Pat. No. 3,046,107. The use of nitrogen in combination with argon and oxygen to achieve predetermined nitrogen contents is disclosed in Saccomano et al in U.S. Pat. No. 3,754,894. A modification of the AOD process is also shown by Johnsson et al in U.S. Pat. No. 3,867,135 which utilizes steam or ammonia in combination with oxygen to refine molten metal.

It is worthy of note that none of the above-mentioned pneumatic melt refining techniques have, prior to this invention, been used by the foundry art for the production of castings.

OBJECTS

It is an object of the present invention to improve the surface quality, internal quality and physical properties of castings.

It is another object of this present invention to improve the method of producing castings by pneumatically refining the melt prior to casting.

It is still another object of this invention to increase the yield of acceptable castings.

SUMMARY

It has now been discovered that by pneumatically refining the melt in a separate vessel prior to casting, castings of a quality superior to that heretofore obtainable can be produced. Such castings have unexpectedly superior surface quality and internal quality.

The above, and other objects which will be apparent to those skilled in the art are achieved by the present invention which comprises:

a process for producing metal castings having improved surface quality and internal quality by: melting selected charge materials in a furnace, teeming the melt into a mold, permitting the melt to solidify in the mold, and removing the casting from the mold, wherein the improvement comprises:

(1) transferring the melt from the melting furnace into a refining vessel provided with at least one submerged tuyere, and (2) refining said melt by (a) injecting into the melt through said tuyere(s) an oxygen-containing gas containing up to 90% of a dilution gas, and (b) thereafter injecting a sparging gas into the melt through said tuyere(s).

Preferably, the oxygen-containing gas stream is surrounded by an annular stream of protective fluid.

The term "refining" as used in the present specification and claims is meant to include any one or more of the following effects: decarburization, dephosphorization, desulfurization, degassing, deoxidation, gaseous alloying, impurity oxidation, impurity volatilization, slag reduction and flotation and homogenization of non-metallic impurities. The present invention is applicable to refining of any iron, cobalt or nickle based alloy, and the term "metal" is used in that sense.

The term "dilution gas" as used herein is intended to mean one or more gases that are added to the oxygen stream for the purpose of reducing the partial pressure of the carbon monoxide in the gas bubbles formed during decarburization of the melt, and/or for the purpose of altering the feed rate of oxygen to the melt without substantially altering the total injected gas flow rate. Suitable dilution gases include: argon, helium, hydrogen, nitrogen, carbon monoxide, carbon dioxide, steam and hydrocarbon gases, for example, methane, ethane, propane and natural gas. Argon is the most preferred dilution gas.

The term "protective fluid" as used herein is meant to include one or more fluids which surround the oxygen containing gas and protect the tuyere and surrounding refractory lining from excessive wear. Suitable protective fluids include: argon, helium, nitrogen, hydrogen, carbon monoxide, carbon dioxide, hydrocarbon fluids (gas or liquid) and steam. Methane, ethane, propane or natural gas are suitable hydrocarbon gases. No. 2, diesel oil is a suitable hydrocarbon liquid. Argon is the most preferred protective fluid.

The term "sparging gas" as used herein is intended to mean one or more gases which remove impurities from the melt by volatilization or transfer to the slag by entrapment or reaction with the slag. Suitable sparging gases include: argon, helium, nitrogen and steam. Argon is also the preferred sparging gas.

Castings having improved surface quality are defined as castings which when compared to the prior art require reduced cleaning, grinding, chipping, welding or other repair. Such improved surface quality can be evidenced by a reduced level of defects determined during dye penetrant or magnaflux testing.

Castings having improved internal quality are defined as castings which when compared to the prior art display one or more of the following characteristics: a lower level of inclusions, finer as-cast grain size, reduced internal porosity, reduced tendency for hydrogen flaking during machining, reduced evidence of defects when inspected by X-ray techniques or better physical properties such as toughness.

THE DRAWING

FIG. 1 represents a cross-sectional view of a preferred refining vessel or converter for use in carrying out the process of the present invention.

DETAILED DESCRIPTION

It was expected that utilization of pneumatic refining for the treatment of steel melts for castings would produce most of the chemical benefits obtained by refining molten steel for the production of wrought steel products. In particular, it was expected that some improved internal quality would be obtained by better deoxidation of the melt, by better separation of deoxidation products, and by the attainment of lower sulfur levels and lower hydrogen content. However, it was unexpectedly discovered that pneumatic refining in accordance with this invention produces improvements in the surface quality of the castings beyond any expectations, that it produces castings with greatly improved strength, ductility and toughness, and that it makes possible the production of castings of far superior quality than previously possible from low alloy steels and carbon steels.

As a result of the present invention, foundries are now able to cast with significantly increased assurance of obtaining satisfactory castings, as well as of obtaining castings of higher quality. More specifically, the surface quality of the resultant castings have fewer cracks and reduced hot tears. In addition, it has been found that use of the present invention produces a smoother casting surface, believed to result from reduced interaction of the sand mold with the melt. It has also been found that the physical properties of the castings have been unexpectedly improved. The improvements are believed to be related to the lower levels of inclusions, lower hydrogen flaking, as well as lower porosity found in castings made in accordance with this invention. Molten steel treated in accordance with the present invention has a higher flowability or fluidity at the same temperature than untreated metal, resulting in superior castings, since the metal will flow into smaller and more intricate crevices than unrefined melt. Alternatively, the same fluidity may be achieved at a lower casting temperature. This again contributes to improved casting surface quality.

The pneumatic refining treatment of the present invention may be advantageously employed on any type of iron or steel melt, and also on cobalt and nickel alloys, normally used for the manufacture of metal castings. It has, however, been found to be particularly beneficial in the treatment of ferritic and austenitic stainless steels, low alloy steels and carbon steels. Special benefits are obtained in castings made steels such as WC6 and HY80 which are sensitive to hydrogen flaking as well as hot tearing. High strength steels such as HY130 which normally require extensive chipping, grinding and welding in order to repair as-cast defects, are significantly improved by the present invention, resulting in considerable finishing cost savings. Austenitic stainless grades such as CN7M, CH20, CK20, 310L, and 347L, which, prior to the present invention, were extremely difficult to cast without cracking or microfissuring, can now by means of the present invention, be readily cast without fear of cracking.

The advantages of the present invention while applicable to small, simple castings as well as to complex or large ones, are of particular significance when producing high quality castings such as required, for example, for pumps and turbines used in the aircraft, shipbuilding and nuclear power industries.

In addition to the unexpected results of the present invention described above, other benefits resulting from use of the present invention include raw material savings due to minimized oxidation of molten metal and the ability to use lower grade charge materials. Increased production also results from greater accuracy in achieving desired aim melt chemistries and fewer rejects due to improved casting quality.

In practicing the present invention, melting of the charge materials may be accomplished by any means known in the art. The most common foundry melting furnaces include fuel fired furnaces of the hearth or crucible type, as well as electric furnaces of the resistance, induction or arc type. The last two are preferred. Following melting of the charge materials, the melt is transferred by a ladle or otherwise poured into the pneumatic converter shown in FIG. 1.

FIG. 1 is a cross-sectional view of a preferred refining vessel 1 for use in practicing the present invention. Vessel 1 comprises an outer steel shell 2, removably attached to a trunion ring 3. The trunion ring and consequently the vessel is tiltable by being fixedly attached by drive means (not shown), in order to facilitate charging, sampling, slag removal and tapping. Shell 2 is lined with basic refractory bricks 4. A removable shell arrangement is preferred, since several shells are necessary to maintain uninterrupted operations. While one shell is in use, the spare or spares are being relined. A horizontally disposed concentric tube tuyere 5 is located in the side-wall of the vessel near the bottom of the vessel for injection of the fluids. If desired, the tuyeres can be located in the bottom of the vessel in place of or in addition to the sides. Preferably, however, at least two tuyeres are used, and positioned in the side-wall of the vessel, near the bottom and horizontally disposed in such manner as to be asymmetric. That is, no two tuyeres should be positioned so that their axes, and consequently the fluid streams are injected diametrically opposed to each other. Asymmetric positioning of the tuyeres improves mixing of the melt by the injected gases. The tuyere 5 consists of an inner tube 6 and a concentric outer tube 7. Oxygen alone or admixed with a dilution gas is injected through the inner tube 6, and the protective gas is injected through the outer tube 7 of the tuyere. The latter forms a protective annular shround around the oxygen stream which protects the refractory lining from rapid deterioration. The pressure of the fluids must be sufficiently great to penetrate into the melt. Preferably, the absolute pressures of the fluids at the tuyere inlets, of both the central and annular passages, are at least two times greater than the absolute pressures of the fluids at the outlets.

A detailed description of a suitable vessel and tuyeres for carrying out the present invention is shown by Saccomano and Ellis in U.S. Pat. No. 3,703,279. The sparging gas may be injected into the melt either through the same tuyere or tuyeres as used for the oxygen stream or through separate tuyeres; the former is preferred. Preferably, after the oxygen blow is completed, the sparging gas is injected through the center passage of the tuyere as well as through the annular passage in order to prevent molten metal from flowing back into the tuyere where it would freeze.

In general, the molten metal refining step of the present process is carried out by injecting oxygen and a dilution gas, as well as protective fluid (both of which may be argon) into the melt through the submerged tuyeres. The decarburization, i.e., the reaction of the injected oxygen with carbon in the melt, produces controlled oxidation of the bath components, as well as heat which maintains bath temperature. The melt is initially blown with a high ratio of oxygen to dilution and protective gases. Depending on the steel composition being refined, as the carbon content of the melt decreases, the ratio of oxygen to dilution gas and protective fluid may be lowered, generally in several steps, in order to maintain favorable thermodynamic conditions throughout the blow.

Since the oxygen and other gases are introduced below the level of the melt and at high velocity, excellent mixing takes place within the melt and intimate gas-metal and slag-metal contact occurs. As a result, the reaction kinetics of all chemical processes which take place within the vessel are greatly improved. This permits desulfurization to very low levels (under 0.005%) generally, in less than ten minutes of blowing and without addition of expensive desulfurizing agents such as calcium, magnesium or rare earths. Dephosphorization of alloys containing less than approximately one percent chromium can readily be achieved by decarburizing the bath to below 0.1% carbon by using a gas mixture containing at least 75% oxygen. The phosphorous bearing slag so formed must then be decanted prior to blowing with a sparging gas or adding any reducing agents, deoxidants, or desulfurizing agents.

Other major benefits of the invention are very close control of the end point carbon and very low residual values of oxygen, nitrogen and hydrogen. Typical residual values for these three elements obtained by practicing the invention are shown in Table I.

TABLE I

| | Stainless Steel | | Low Alloy Steel | |
|---|---|---|---|---|
| Oxygen | 40–70 | ppm | 20–50 | ppm |
| Hydrogen | 2–4 | ppm | 1–3 | ppm |
| Nitrogen | 150–200 | ppm | 20–50 | ppm |

In addition, lead, and zinc in the melt are reduced to levels that are metallurgically harmless.

The synergistic results obtained by the present invention, i.e., low gas content (oxygen, nitrogen and hydrogen) together with low sulfur and increased fluidity of the melt have combined to produce castings of unprecedented surface quality, internal cleanliness and improved mechanical properties. Table II below compares the chemical and physical properties of two castings of stainless steel grade CA6NM, one made by conventional practice and the other by the present invention with ASTM specification A296.

TABLE II

| Chemistry (%) | ASTM Spec. A296 | Conventional | Invention |
|---|---|---|---|
| C | 0.06 max | .05 | 0.026 |
| Mn | 1.00 max | .60 | 0.47 |
| Si | 1.00 max | .55 | 0.96 |
| Cr | 11.5–14.0 | 12.70 | 12.81 |
| Ni | 3.5–4.5 | 3.80 | 4.00 |
| Mo | 0.40–1.00 | 0.50 | 0.57 |
| S | 0.03 max | 0.025 | 0.022 |
| P | 0.04 max | 0.020 | 0.025 |
| Mechanical | | | |
| Tensile (ksi) | 110 min. | 115 | 122.8 |
| Yield (ksi) | 80 min. | 100 | 108.3 |
| Elongation (%) | 15 min. | 20 | 21 |
| Red. of area (%) | 35 min. | 60 | 67 |
| Impact Strength Charpy V-notch (at R.T.) | none | 65 | 77–80 |

It can be seen from Table II that the casting made in accordance with the present invention is superior in all respects, and particularly in impact resistance. The difference in toughness is even more impressive when one recognizes that in this particular casting the sulfur level was 0.22% rather than the customary value of less than 0.01% obtainable with pneumatic refining. In this case no special desulfurizing treatment was employed.

With high strength alloys such as HY-130 and 85% improvement in impact strength has been obtained on a casting made from HY-130 in accordance with this invention when compared to a casting of the same alloy made from vacuum degassed metal. Such high impact strength far exceeds any previously obtained impact strength on castings made from this alloy.

EXAMPLE 1

An electric arc furnace was charged with 6290 lbs. of HY-80 scrap, 5869 lbs. of mild steel scrap and 300 lbs. of lime. Power was applied to the electrodes and the charge was melted in approximately one hour. Following melt down, the composition was adjusted, in accordance with conventional practice, to have the furnace tap composition shown below, and a temperature of about 3100° F.

The above melt was tapped from arc furnace into a transfer ladle, and then charged into the refining vessel. 500 lbs. of lime, 100 lbs. of MgO and 60 lbs. of aluminum were added to the charge. At the start of the pneumatic refining period the temperature of the melt was 2900° F. The melt was blown through two submerged, horizontal, concentric-tube tuyeres, asymmetrically positioned in the lower side-wall of a refractory-lined refining vessel such as shown in FIG. 1.

The blowing gas, consisting of oxygen diluted with argon, was injected through the center tube of the tuyeres. Argon was used as the protective fluid, and injected through the annular passage of the tuyeres. The ratio of the oxygen flow rate to that of the combined argon flows was 3 to 1. A total of 2150 ft.$^3$ of oxygen was injected. The combined gas flow rate of the injected gases was about 6000 SCFH. About 9 minutes after the flow began, 11 lbs. of charge chrome and 18 lbs. of standard manganese were added to the melt. At the end of the blow the temperature of the melt was 3080° F. and the carbon content was 0.10%.

Following the addition of 100 lbs. of 50% FeSi, the melt was sparged and stirred by injecting argon at a rate of about 4000 SCFH for 4 minutes through both passages of both tuyeres. The melt temperature at this time was 3000° F. The melt was then conventionally deoxidized and sparged with argon for 2 more minutes before being tapped into a bottom pouring ladle for subsequent teeming into molds. The furnace tap composition and the final composition of the refined melt at tap are tabulated below.

| Analysis | % C | % Mn | % Si | % Cr | % Ni | % Mo | % P | % S |
|---|---|---|---|---|---|---|---|---|
| Furnace Tap | 0.32 | 0.54 | 0.55 | 1.29 | 2.85 | 0.43 | 0.014 | 0.004 |
| Refined Melt | 0.10 | 0.61 | 0.35 | 1.49 | 2.97 | 0.42 | 0.017 | 0.001 |

EXAMPLE 2

For purposes of comparison, a conventionally processed heat of HY-80 was prepared as follows. An electric arc furnace was charged with 15,000 lbs. of HY-80 scrap, 55 lbs. of charge chrome, 14,082 lbs. of mild steel scrap and 600 lbs. of lime. Power was applied to the electrodes and the charge was melted and heated to 2790° F. in approximately 75 minutes. About 4000 SCF of oxygen was then injected into the bath by means of a hand-held consumable lance. The slag formed thereby was skimmed off, and the bath temperature was measured to be 2850° F.

The following additions were then made to the melt: 200 lbs. carbon, 500 lbs. 50% FeSi, 500 lbs. lime, 220 lbs. charge chrome, 285 lbs. Ni, and 66 lbs. Mo $O_3$.

Power was again applied to the electrodes and the bath temperature was increased during a period of 45 minutes to 3020° F. At this point, a preliminary sample was taken which had the analysis shown below. Thereafter, additions of 500 lbs. lime, 200 lbs. charge chrome, 135 lbs. Ni and 28 lbs. FeMo were made, and the melt was further decarburized by injecting 6700 SCF of oxygen into the bath by means of a handheld consumable lance. After about 20 minutes of blowing, the carbon was measured to be 0.07%. 275 lbs. of SiMn and 131 lbs. of 75% FeSi were added, and the heat was immediately tapped and sampled. The final tap composition is also shown below.

| Analysis | % C | % Mn | % Si | % Cr | % Ni | % Mo | % P | % S |
|---|---|---|---|---|---|---|---|---|
| Preliminary | 0.63 | 0.26 | 1.06 | 0.93 | 2.32 | 0.34 | 0.016 | 0.006 |
| Furnace Tap | 0.10 | 0.63 | 0.47 | 1.40 | 2.79 | 0.40 | 0.015 | 0.007 |

Table III below compares the physical properties of the castings produced from the melts prepared in Examples 1 and 2 above, both of which were heat treated in substantially the same manner in accordance with conventional techniques

TABLE III

| | Example 1 | Example 2 |
|---|---|---|
| Tensile Strength (psi) | 102,750 | 102,325 |
| Yield Strength (psi) | 87,200 | 87,900 |
| Elongation (%) | 22 | 21 |
| Reduction of Area (%) | 55 | 53 |
| Impact Strength (ft. lbs) at-100° F. (Charpy "V"-notch) | 58,100,108 | 44,45,37 |

It can be seen from Table III that all of the properties of the castings, other than greatly improved impact strength of the castings made by the present invention, are substantially the same. One would expect, to obtain similar properties since both the chemical composition and heat treatment of the castings were substantially the same. The improved impact strength is believed to reflect the improved internal cleanliness of the melt produced in accordance with the present invention. While this increase in toughness is, in itself, a considerable improvement in the quality of the casting, an additional improvement of great significance was observed in the cleaning and finishing of the castings. The castings made from the melt of Example 1, required substantially less cleaning, grinding, welding and other repair than the prior art casting made from the melt of Example 2. This improvement was unexpected and not predictable from past experience, and is of great importance to the foundry industry since the labor savings involved represent a significant portion of the value of the casting.

In addition to the unexpected improvements described above, other improvements on HY-80 castings made in accordance with this invention have also been found. For example, the welds required to repair an experimental casting made by the present invention numbered only 5, as compared to 95 repair welds required on the same casting made by conventional practice. Further, castings made by the present invention displayed no hydrogen flaking even in 13" sections.

EXAMPLE 3

An electric arc furnace was charged with 8947 lbs. of 18–8 stainless steel scrap, 40 lbs of carbon and 500 lbs. of lime. Power was applied to the electrodes and the charge was melted. Following melt down, the composition was conventionally adjusted to have a furnace tape composition shown below and a temperature of about 3100° F.

The above melt was tapped from the arc furnace into a transfer ladle and then charged into the refining vessel. 500 lbs. of lime was added to the charge. At the start of the pneumatic refining period the temperature of the melt was 2910° F. The melt was blown through two submerged, horizontal, concentric-tube tuyeres, asymmetrically positioned in the lower side-wall of a refining vessel as shown in FIG. 1. The blowing gas consisted of oxygen diluted with argon injected through the center tubes. Argon was injected as the protective fluid through the annular passage of the tuyeres. The ratio of oxygen to the combined argon flow rates was 3 to 1. A total of 1800 ft.$^3$ of oxygen was injected. The combined flow rate of the injected gases (i.e., oxygen plus argon) was about 7000 SCFH. After 21 minutes of blowing at the 3:1 ratio, the melt temperature was 3120° F. and the carbon content was 0.15%. The ratio of the oxygen flow rate to that of the combined argon flows was then changed to 1:1. At this ratio the injection was continued for about 15 minutes during which time 1000 ft.$^3$ of total oxygen was injected. Thereafter, the ratio of oxygen to combined argon flows was again changed to 1:3, and 100 ft.$^3$ of oxygen was injected over about 4 minutes time. 400 lbs. of FeCrSi, 100 lbs. lime and 215 lbs. of 50% FeSi was then added, and the melt stirred and sparged for 17 minutes with argon alone injected through both passages of both tuyeres. The tap temperature was 2920° F. The heat was then tapped into a bottom pouring ladle for subsequent teeming into molds.

| Analysis | % C | % Mn | % Si | % Cr | % Ni | % Cu | % Mo | % P | % S |
|---|---|---|---|---|---|---|---|---|---|
| Furnace Tap | 0.35 | 0.75 | 0.34 | 19.29 | 8.95 | 0.34 | 0.65 | 0.029 | 0.00 |
| Refined Melt | 0.02 | 0.70 | 1.47 | 20.09 | 9.54 | 0.33 | 0.63 | 0.028 | 0.00 |

EXAMPLE 4

For purposes of comparison, a conventionally processed heat of 18–8 stainless steel was prepared as follows. An electric arc furnace was charged with 18,702 lbs. of 18–8 scrap, 374 lbs. FeNi, 150 lbs. carbon and 2500 lbs. of lime. Power was applied to the electrodes and the charge was melted and heated to 2850° F. in approximately 118 minutes. A preliminary sample taken at this time had the composition shown below. About 12,000 SCF of oxygen was then injected into the bath via a hand-held consumable lance. The slag formed thereby was skimmed off, and the following additions were made to the melt: 2278 lbs. FeCrSi, 300 lbs. low CFeCr, 800 lbs. lime, 80 lbs. Ni.

Power was again applied to the electrodes and the heat was tapped into a ladle for subsequent teeming into molds. The preliminary sample composition and the final tap composition are shown below.

| Analysis | % C | % Mn | % Si | % Cr | % Ni | % Mo | % P | % S |
|---|---|---|---|---|---|---|---|---|
| Preliminary | 0.45 | 0.58 | 0.42 | 17.65 | 8.78 | 0.83 | 0.028 | 0.010 |
| Tap | 0.05 | 0.63 | 1.21 | 19.84 | 8.85 | 0.78 | 0.033 | 0.005 |

The mechanical properties of the castings made from the melts of Examples 3 and 4, i.e., the invention and the prior art respectively, were substantially the same. However, the average time required for cleaning and repair, based on 6 castings, made by the invention was approximately 30% less than the average time required for cleaning and repair of 7 like castings made by the prior art.

What is claimed is:

1. A process for producing final product castings of low alloy steel and carbon steel, said castings being characterized by superior internal and surface quality, comprising the steps of:

(1) melting selected charge materials in a furnace, (2) transferring the melt from the melting furnace into a refining vessel provided with at least one submerged tuyere, (3) refining said melt in said refining vessel by (a) injecting into the melt through said tuyere(s) a mixture of oxygen and at least one dilution gas, said dilution gas functioning (i) to reduce the partial pressure of the carbon monoxide in the gas bubbles formed during decarburization of the melt, (ii) to alter the feed rate of oxygen to the melt without substantially altering the total injected gas flow rate, or (iii) both (i) and (ii), and thereafter (b) injecting a sparging gas into the melt through said tuyere(s), said sparging gas functioning to remove impurities from the melt by degassing, deoxidation, volatilization, or by flotation of said impurities with subsequent entrapment or reaction with the slag, (4) teeming the melt into a cast product mold, (5) permitting the melt to solidify in the mold, and (6) removing the casting from said mold.

2. The process of claim 1 wherein the oxygen-containing gas stream is surrounded by an annular stream of a protective fluid, said protective fluid functioning to protect the tuyere(s) and surrounding refractory lining from excessive wear.

3. The process of claim 1 wherein the dilution gas is selected from the group consisting of argon, helium, hydrogen, nitrogen, carbon monoxide, carbon dioxide, steam and a hydrocarbon gas.

4. The process of claim 1 wherein the dilution gas is argon.

5. The process of claim 1 wherein the sparging gas is selected from the group consisting of argon, helium, nitrogen and steam.

6. The process of claim 1 wherein the sparging gas is argon.

7. The process of claim 1 wherein the protective fluid is selected from the group consisting of argon, helium, hydrogen, nitrogen, carbon monoxide, carbon dioxide, steam and a hydrocarbon fluid.

8. The process of claim 1 wherein the protective fluid is argon.

9. The process of claim 1 wherein the refining vessel is provided with at least two submerged tuyeres.

10. The process of claim 1 wherein the tuyeres are located in the side-wall of the vessel near the bottom, disposed horizontally, and positioned such that the tuyere axes are asymmetric.

11. The process of claim 1 wherein the absolute pressure of the injected fluids at the tuyere inlets is at least two times the absolute pressure of the fluids at the tuyere outlets.

* * * * *